United States Patent [19]

Langree

[11] 3,970,978

[45] July 20, 1976

[54] ELECTROMAGNET

[75] Inventor: Michel Langree, Poitiers, France

[73] Assignee: La Telemecanique Electrique, France

[22] Filed: Jan. 3, 1975

[21] Appl. No.: 538,384

[30] Foreign Application Priority Data

Jan. 31, 1974 France ..... 74.03255

[52] U.S. Cl. ..... 335/203; 335/276; 335/279

[51] Int. Cl.[2] ..... H01H 50/18

[58] Field of Search ..... 335/203, 128, 125, 279, 335/272, 276, 270

[56] References Cited

UNITED STATES PATENTS

| | | | |
|---|---|---|---|
| 3,325,660 | 6/1967 | Boyers | 335/276 |
| 3,435,395 | 3/1969 | Rosenberg et al. | 335/279 |
| 3,548,353 | 12/1970 | Bausch | 335/276 |

*Primary Examiner*—Harold Broome
*Attorney, Agent, or Firm*—William A. Drucker

[57] ABSTRACT

The object of the present invention is a direct current-operated electromagnet.

The branch of the armature which penetrates the coil body cooperates with a fixed core branch in three distinct successive modes due to the action of different air gaps.

It can advantageously be used on relays for automatic equipment or on small contactors whose number of contacts is variable and/or subject to time lags.

5 Claims, 4 Drawing Figures

Fig. 2
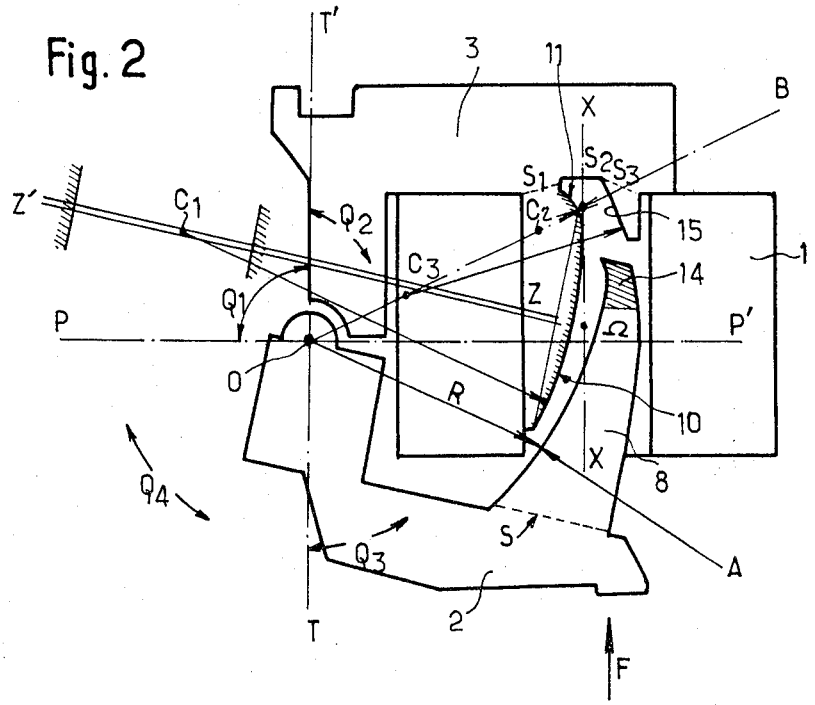
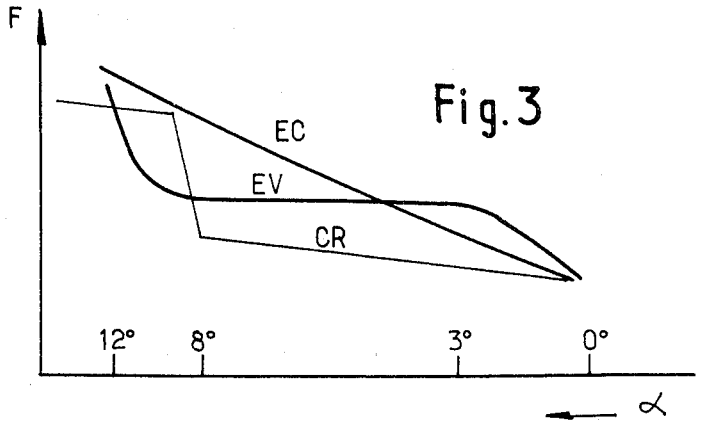
Fig. 3
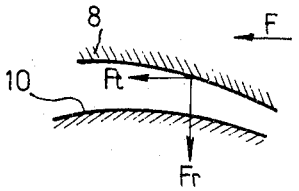
Fig. 4

ELECTROMAGNET

The invention relates to an electromagnet comprising a coil and a magnetic circuit having a fixed U-shaped core and a movable armature which is substantially L-shaped, which are interconnected by a pivoting system which links a first arm of the core with a first arm of the armature leaving a certain air gap, whilst the second arms of both core and armature whose surfaces are curved face one another in an area surrounded by the coil.

Such electromagnets are particularly used in relays for automatic equipment having a certain size where the coil is excited with direct current.

Electromagnets of the above type according to the prior art are known wherein the curved surfaces delimiting the pole surfaces are concentric to the rotation axis of the armature.

In these electromagnets the torque is progressive and due to the fact that the air gap is of constant width the tangential component which generates the torque is relatively small relative to the radial component of the magnetic attraction forces.

This leads to excessive friction on the armature bearings and the movement of the armature at such a slow speed that the coil has to generate high ampere turns in order to overcome the opposing torque due to the restoring spring of the armature.

Moreover, even in the most favourable case there is no significant variation in the torque at the time when the reaction of the springs ensuring the pressure of the contacts is added to the restoring spring force.

In order to reduce the ampere turns of the coil and consequently bring about a substantial economy in both copper and energy, it is desirable that the restoring torque of the electromagnet develops rapidly in its starting phase followed by a moderate development in the approach phase and terminated by a rapid development phase at the time when the contacts engage and the springs are placed under tension.

Thus the kinetic energy accumulated in the first two stages of the travel are used to successfully overcome the third stage which is that requiring most energy, particularly due to the possibility of assembling on the apparatus of auxiliary contacts or retarded devices acting at certain points in the armature travel.

According to the invention, this result is achieved through the curved surface of the second arm of the fixed core comprising two successive portions, whereof the second portion adjacent to the base of the U is located facing a pole piece integral with the base, whilst the second arm of the armature comprises two successive portions whereof the second adjacent to the end of this arm is located in an area between the second portion of the core surface and the pole piece, whilst the end of the second portion of the armature has a pole surface located transversely relative to the direction of movement of the armature to form with a surface located between the second arm of the fixed core and the pole piece an air gap whose attraction action becomes effective when the second portion of the said armature engages substantially in half the said area.

Other features serving to improve and adapt the attraction torque variation law as a function of the armature rotation angle will be better understood from the following description relative to the accompanying drawings, wherein:

FIG. 2 shows more particularly the geometrical characteristics of the magnetic circuit;

FIG. 3 is a graph illustrating the laws of evolution of the different types of electromagnet relative to the opposing forces;

FIG. 4 is a diagram showing the ways in which the attraction forces exerted between two facing pole surfaces can be broken down.

Figure 1:
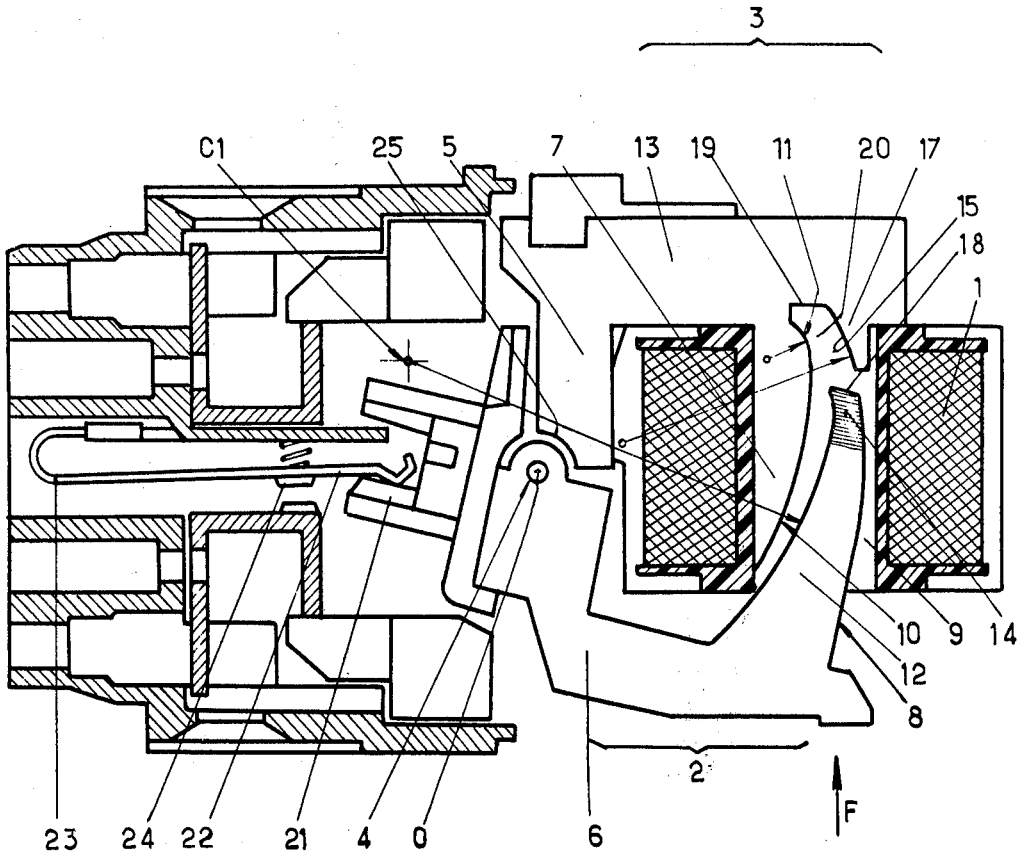
FIG. 1 is an elevation of the electromagnet associated with its main components.

In FIG. 1, 1 is the excitation coil of the electromagnet having a bobbin which is moulded from plastic material.

The magnetic circuit comprises a fixed core 3 having the general shape of a U with arms 5 and 7 and a base 13. The fixed core 3 is associated with the aid of a pivot 4 with a movable armature 2 having the general shape of an L whose first and second arms are 6 and 8 respectively arm 6 is spaced from arm 5 by a small constant air gap 25.

In the rest state and in the working position of the electromagnet the second arms 7,8 enter the inner zone 9 of coil 1.

The curved surfaces of arms 7 and 8 have between them an air gap whose development during the movement of the armature depends on the radius and centre of curvature of these surfaces. The attraction law is itself a function of these variables.

If the air gap between these two surfaces is constant, the attraction force would be proportional to the armature travel as shown on curve EC of FIG. 3 in which case the radial forces are too high relative to the tangential forces.

In order under these conditions to overcome in advantageous manner the opposing forces CR it is preferable to adopt a force variation law similar to that illustrated by curve EV. For this purpose the various attraction forces exerted on the armature are broken down into three successive phases.

The curved surface of fixed arm 7 is consequently formed by two successive portions 10 (indicated by cross-hatching) and 11 (indicated by dotted lines), whereby the first portion extends from the end of the arm to the second surface portion 11 which terminates adjacent to base 13 of the core.

Facing surface 11 is provided a third surface 15 belonging to a pole piece 17 which is integral with base 13. Therefore between these two surfaces is left an empty area called space 20.

The second arm 8 of the armature can be sub-divided into two portions 12 and 14 whose functions are not identical. The first portion 12 substantially cooperates with surface 10 of the core in a first portion of its travel terminating at the moment when the second portion 14 (indicated by cross-hatching enters space 20.

At this time the magnetic attraction phenomenon due to a significant variation of the air gap is replaced by a magnetic attraction action comparable to that of a plunger, namely during a second portion of the travel which brings end area 14 substantially into the centre of space 20.

As this end portion 14 has a pole surface 18 which is substantially transverse relative to the direction of movement F of the armature, the approach of surface 19 constituting the base of space 20 and located between surfaces 11 and 15 brings about a strongly tangential magnetic attraction controlling the third portion of the armature travel.

The development of the tangential attraction force visible on curve EV of FIG. 3 corresponds to the succession and combining of the three attraction modes described hereinbefore. When armature 2 is in its fully attracted position its pole surface 18 abuts against a thin brass blade which serves to prevent residual magnetism and arm 8 is only separated from surface 10 by a small air gap of constant width.

In this same position the arm of an insulating member 21 integral with the armature raises end 22 of a flexible blade 23 carrying a contact 24 which therefore opens when the coil is excited.

It should be noted that the arrangement described hereinbefore makes the law concerning the variation of armature forces as a function of the displacements of the latter dependent on a certain number of independent parameters whose limits must be studied and whose values must be defined in order to obtain the best possible result which depends mainly on the energy to be allocated to the coil and the sum of the opposing forces. Within the scope of the problem to be solved by the invention, it should be noted that the electromagnet will be called on to operate additional pneumatic timing devices or contacts whose opposing forces are involved with various positions of the armature.

The variation of the different air gaps during the movement of the armature depends on the position of the centre of rotation thereof relative to the radius of curvature of the facing surfaces and the position of the centre of curvature of these surfaces. If reference is made to FIG. 2 showing the magnetic circuit in its rest state, O is the centre of rotation of the armature, XX' the axis of coil 1, PP' the path of a plane perpendicular to XX' passing through O, and TT' is the path of a plane passing through O parallel to XX'.

Paths PP' and TT' define four quadrants Q1, Q2, Q3, Q4. If C1 is the centre of curvature of the portion of surface 10, it can be seen that its position can only be located in one of the quadrants Q1 or Q2 because if C1 was located in one of the quadrants Q3 or Q4 it would be mechanically impossible to move the armature relative to the core.

When C1 is placed in the first quadrants a variation of the air gap placed between the surface 10 and movable arm 8 occurs, leading to a tangential force Ft (i.e. in the direction of arrow F) which is high relative to the radial force Fr (directed towards the centre of rotation), cf. particularly FIG. 4.

Moreover, if it is desired that the conditions of magnetic saturation at the base of arm 7 are comparable to those of the base of pole piece 17 and that the whole length of arm 7 be used, curved surface 10 must pass through points B and A whereby B is defined as a point adjacent to the axis XX' located in space 20, defined hereinbefore, and A being a point adjacent to the end of arm 7, and therefore also adjacent to the edge limiting inner zone 9 of the coil. The centre of curvature C1 is therefore also adjacent to the median line of segment AB.

Numerous tests have shown that the desired outline of the force curve is obtained when the radius of curvature of surface 10 is between 1.3 and 2 times the value of the distance R separating point A from the centre of rotation O. In fact if the radius of curvature is too small the variation of the air gap leads to too high a value of the radial component relative to the tangential component, whereas if the radius of curvature is too large the air gap is too great and a rise in magnetic leaks impairs efficiency.

If the radius of curvature of surface 10 is located in quadrant Q2 the air gap tends to increase during the rotation of the armature.

However, this effect has been chosen for the surface 11 of arm 7 and the surface 15 of pole piece 17 in order to obtain a quasi-constant pattern of the attraction force corresponding to rotation between about 3° and 8° on FIG. 3.

The radius of curvature of surface 11 bordering C2 has been made smaller than the radius of curvature of surface 15 bordering C3 so that the radial component due to the air gap between portion 14 of the armature and surface 15 of the pole piece relieves pivot 4 placed in the centre of rotation O.

In view of the necessity of portion 14 passing into space 20, the centres C3, C2 of the radii of curvature are adjacent to a straight line passing through points O and B.

The importance attributed to the purely tangential attraction due to the variation of the air gap present between surfaces 18 and 19 has led to the latter being given values close to the values of the base sections of arm 7. Thus if S represents the maximum section of arm 8 of the armature entering zone 9 of the coil, section S1 of the base of arm 7, section S2 of pole surface 19 and section S3 of the base of pole piece 17 are each substantially equal to a third of section S.

The surface portion of the portion 14 of arm 8 positioned facing surface 11 has an appearance similar to the latter. However, to permit its easy introduction into space 20 it has been given a larger radius of curvature.

In the advantageous embodiment described it is laid down from the outset that the centre of rotation O is contained in a plane PP' perpendicular to axis XX' and passing adjacent to centre Ω of coil 1. This is not in fact fixed in arbitrary manner and results from the fact that the dimensions of zone 9 of the coil have a ratio of length to cross-section which is optimum for a given angular displacement of the armature.

The measures described hereinbefore can undergo modification without, however, exceeding the scope of the invention. Thus the curved surfaces can be replaced by planar portions. However, although such variants could be of interest from the construction standpoint, they could lead to reduced performance.

I claim:

1. An electromagnet constituted by (i) a coil the inner zone of which has a certain axial length, and (ii) a magnetic structure, said magnetic structure comprising (a) a fixed core in the form of a "U" having a base joining a first fixed arm placed externally of the coil, and a second fixed arm having a convex external surface disposed over substantially the whole of its length, in the interior of the coil, and (b) a movable armature in the form of a "U" having a first movable arm of which one end mounted on a pivot is associated with the first fixed arm by a small air gap and a second movable arm having a first internal curved surface which is spaced by a first variable air gap from the external curved surface of the second fixed arm, and of which the end is provided with a pole surface which is transverse with respect to said first variable air gap and which is spaced by a second variable air gap from a transverse fixed surface on an extension of the base, the said extension comprising an auxiliary concave surface disposed over a portion of its length within the coil and directed towards the external convex surface, the end of the second movable arm becoming disposed, when the coil is energised, in a space between the curved external surface of the second fixed arm, the auxiliary concave surface and the transverse fixed surface, the magnetic attraction of the said end becoming effective when it is engaged substantially half way into said space.

2. An electromagnet, according to claim 1, in which the external convex surface of the second fixed arm comprises a first portion adjacent to the transverse surface and a second portion extending from the first portion up to the end of the second fixed arm, the centre of curvature of the second portion having disposed substantially on the median line joining that point which is common to the two portions of the surface which is substantially in the axis of the coil and the said end, the radius of curvature of the said second portion being between 1.3 and 2 times the distance separating the pivot from the said end, the centre of curvature of the second portion being disposed in a quadrant of which the apex is on the pivot and which is opposite to the quadrant containing the armature.

3. An electromagnet, according to claim 2, in which the centres of curvature of the first portion of the fixed arm and of the auxiliary concave surface are disposed on a straight line passing through the pivot and through the point common to the two portions of the external convex surface.

4. An electromagnet, according to claim 3, in which the section of the first fixed arm adjacent to the base, the transverse surface and the section of the extension are each equal to ⅓ of the section of the opening of the coil.

5. An electromagnet, according to claim 1 wherein the centre of rotation of the armature is close to the plane passing through the axial centre of the coil and perpendicular to the coil axis.

* * * * *